United States Patent [19]

Pildysh

[11] Patent Number: 5,050,355

[45] Date of Patent: Sep. 24, 1991

[54] GROUND ANCHOR

[76] Inventor: Mikhail Pildysh, 30 Douglas Bank Drive SE., Calgary, Alberta, Canada, T2Z 2B7

[21] Appl. No.: 559,826

[22] Filed: Jul. 30, 1990

[30] Foreign Application Priority Data

Apr. 3, 1990 [CA] Canada ..... 2013773

[51] Int. Cl.[5] ..... E02D 5/74

[52] U.S. Cl. ..... 52/163; 52/166; 411/342; 411/344

[58] Field of Search ..... 52/162, 163, 164, 166; 411/341, 342, 340, 344

[56] References Cited

U.S. PATENT DOCUMENTS

| | | | |
|---|---|---|---|
| 1,086,053 | 2/1914 | Howell | 52/162 |
| 4,096,673 | 6/1978 | Deike | 52/163 X |
| 4,245,545 | 1/1981 | Freeman | 411/342 |

*Primary Examiner*—David A. Scherbel
*Assistant Examiner*—Creighton Smith
*Attorney, Agent, or Firm*—George Haining Dunsmuir

[57] ABSTRACT

One form of conventional earth anchor device includes an anchor which is driven into the ground as the leading element of a combination. Thus, the anchor must be streamlined to facilitate ground entry which is incompatible with the need for a curved body facilitating anchoring. Another problem is the need for anchors having large bearing areas which require considerable effort for insertion into the ground. A device providing a solution to these problems includes a tube or sleeve with a sacrificial blade releasably mounted in the bottom end thereof for driving into the ground, and a rod carrying an anchor and a spring biasing the anchor outwardly, whereby the sleeve can be driven into the ground, following which the rod is held down while the sleeve is extracted, leaving the blade, and, when the anchor and spring exit the sleeve, the spring biases the anchor into a ground engaging position. An upward pull on the rod pivots the anchor into a secure anchoring position in the ground.

7 Claims, 3 Drawing Sheets

GROUND ANCHOR

BACKGROUND OF THE INVENTION

This invention relates to an earth or ground anchor device, and in particular to a device of the type which is used to hold a guy wire or the like.

Earth anchors of the type proposed herein, i.e. employing the same concept as the present invention, have been in existence for some time. Examples of such anchors are described in Canadian Patent No. 1,045,331, which issued to R. F. Deike on Jan. 2, 1979, and in U.S. Pat. No. 4,096,673, which issued to R. F. Deike on June 27, 1978.

In general, existing ground anchors have significant disadvantages. One such disadvantage is the anchoring ability of the device which is dictated by the size of the anchor. In soft soil, larger bearing areas are required; otherwise, the bearing capacity of the soil around the anchor is exceeded, causing release of the anchor. Large anchors cause insertion problems, because a substantial effort is required to drive the anchors into the ground. Another disadvantage of existing anchor devices is that such devices are driven into the ground anchor first, i.e. with the anchor at the bottom, penetrating end of the device. In order to maximize the anchoring capacity, the device should be curved. This need is incompatible with the streamlined shape required for driving a pointed article into the ground. Attempts to effect a trade-off between the two requirements has resulted in anchoring devices which are deficient in terms of anchoring ability and/or ease of insertion into the ground.

An object of the present invention is to overcome the above-identified problems by providing a relatively simple anchoring device which is easy to insert into the ground, regardless of soil conditions.

Another object of the invention is to provide an anchoring device which may include one or more anchors for simultaneous insertion into the ground as required by soil conditions.

BRIEF SUMMARY OF THE INVENTION

Accordingly, the present invention relates to an earth anchor device comprising sleeve means for hammering into the ground; blade means releasably mounted in the bottom end of said sleeve means for facilitating entry of the device into the ground; rod means for insertion into and removal from said sleeve means; anchor means pivotally mounted on said rod means for rotation around a horizontal axis, said anchor means being slidable in said sleeve means with said rod means; and spring means on said rod means biasing said anchor means outwardly against said sleeve means when the rod means and anchor means are inserted therein, whereby, when the sleeve means carrying the remainder of the device is hammered into the ground and then extracted while the rod means is held down against the blade means, the spring means biases the anchor means into a ground engaging position.

BRIEF DESCRIPTION OF THE DRAWINGS

The invention will be described in greater detail with reference to the accompanying drawings, which illustrate a prepared embodiment of the invention, and wherein.

DESCRIPTION OF THE PREFERRED EMBODIMENT(S)

Figure 1:
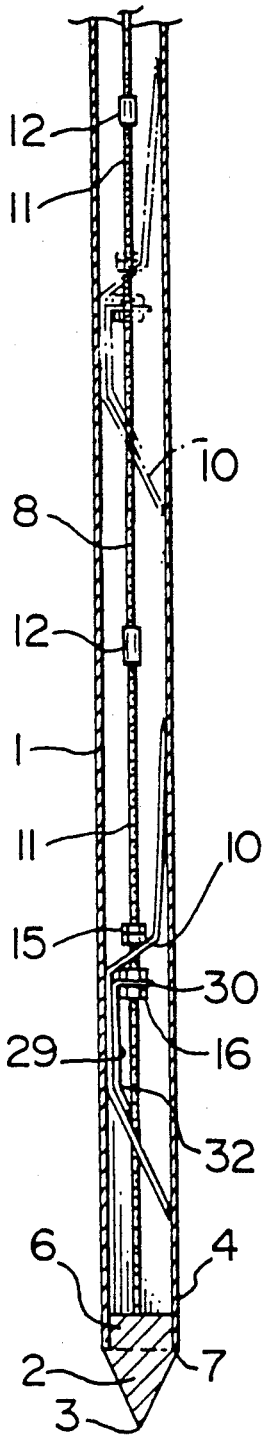
FIGS. 1 and 2 are longitudinal sectional views, at right angles to each other, of an anchor device in accordance with the present invention.
Figure 2:
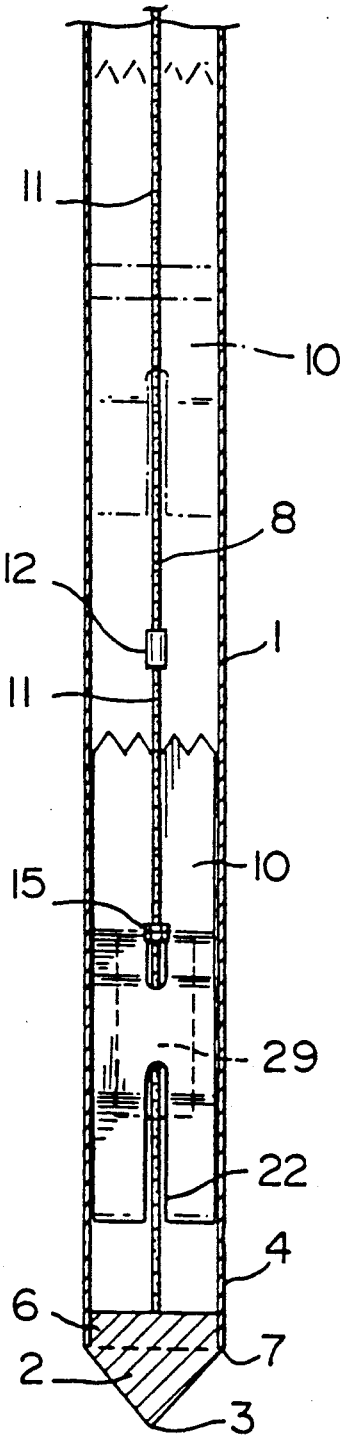

With reference to FIGS. 1 and 2, the anchor device of the present invention includes an elongated metal sleeve 1 of rectangular cross section. A blade 2 with a pointed bottom end 3 is releasably mounted in the bottom end of the sleeve 1 facilitating hammering of the sleeve into the ground. The top end 6 of the blade has a reduced diameter for insertion into the bottom end 4 of the sleeve 1. A shoulder 7 at the bottom end of the reduced diameter portion 6 preventing the entry of material into the sleeve 1 when the device is hammered into the ground. A rod 8 carrying an anchor body 10 is slidably mounted in the sleeve 1. As suggested by the phantom outlines in FIGS. 1 and 2, the rod 8 can carry more than one anchor 10. The rod 8 is defined by a plurality of threaded sections 11 interconnected by internally threaded couplers 12. When the anchor is being embedded a short distance in the ground, a single elongated, threaded rod section 11 can be used.

Figure 3:
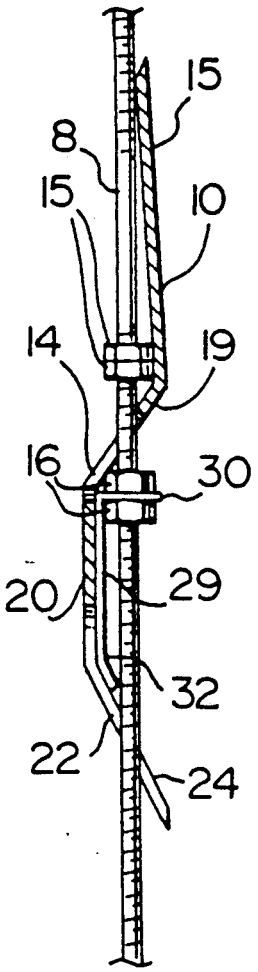
FIG. 3 is a longitudinal sectional view of a rod and anchor used in the device of FIGS. 1 and 2.
Figure 4:
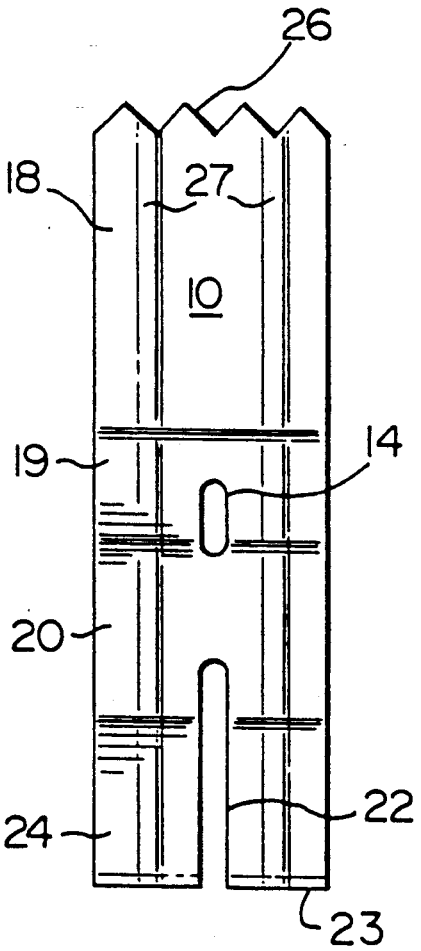
FIG. 4 is a front elevational view of the anchor of FIG. 3.

As best shown in FIGS. 3 and 4, the anchor 10 is defined by an elongated strip of metal with a slot 14 in the center thereof for pivotally mounting the anchor on the rod 8. The anchor 10 is maintained on the rod 8 by top and bottom nuts 15 and 16, respectively. The anchor 10 is defined by an upper leg 18 on one side of the rod 8, a centre section or portion 19 containing the slot 14 and straddling the rod 8, and a lower leg 20 extending outwardly and downwardly from the other side of the rod 8. The lower leg 20 includes an elongated central slot 22 extending upwardly from the bottom edge 23 of the anchor 10. The bottom free end 24 of such lower section 20 is bent into overlapping relationship with the rod 8 beneath the nuts 16, the slot 22 straddling the rod 8. The top end 26 of the anchor 10 is sharp and serrated, facilitating penetration of the soil. A pair of corrugations or ribs 27 extend longitudinally of the anchor 10 for strengthening the latter. A generally inverted L-shaped leaf spring 29 is mounted on the rod 8. One arm 30 (FIGS. 1 and 3) of the spring 29 is sandwiched between the two lower nuts 16. The other arm 32 of the spring extends downwardly against the inner surface of the lower leg 20 of the anchor body 10.

Figure 5:
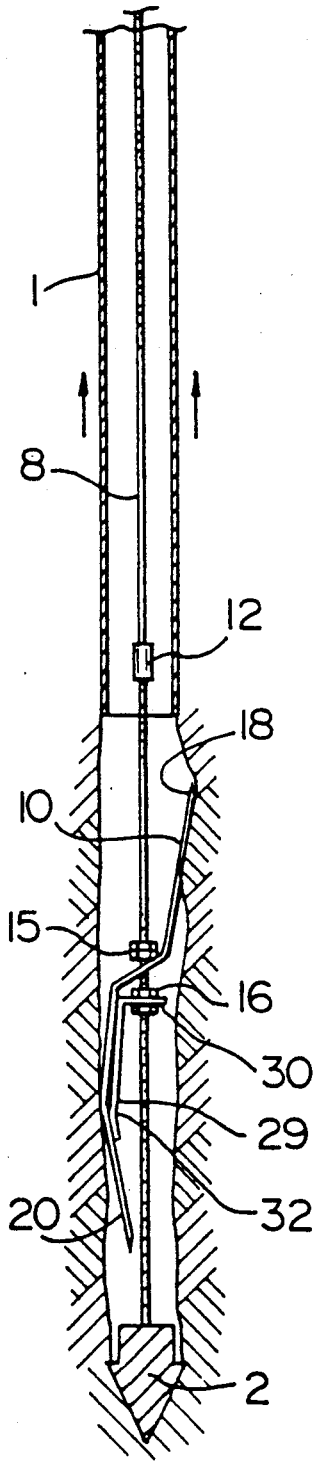
FIGS. 5 and 6 are longitudinal sectional views of a hole in the ground with the device of the present invention therein.
Figure 6:
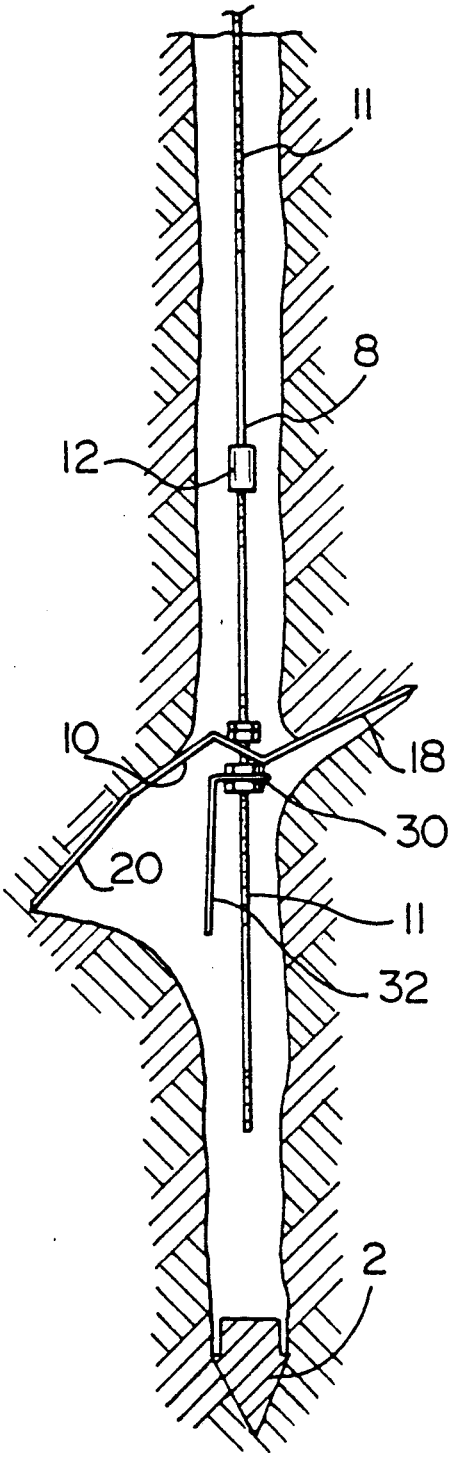

In use, one or more anchors 10 are mounted on the rod 8 and slid into the sleeve 1. When inserting the anchor 10 into the sleeve 1, it is necessary to press the legs 18 and 20 towards the rod 8, deforming or tensioning the spring 29. Thus, when the anchor 1 is located in the sleeve 1, the spring 29 biases the upper and lower legs 18 and 20, respectively of the anchor body 10 is biased outwardly above the nuts 15 and below the nuts 16 against the walls of the sleeve 1. The sleeve 1 is hammered into the ground to the desired depth. While holding the rod 8 down, the sleeve 1 is pulled out of the ground (FIG. 5). When the anchor 10 is released by the sleeve 1, the spring 29 presses the upper and lower legs 18 and 20, respectively outwardly against the sides of the hole. If the rod 8 is pulled upwardly (FIG. 6) the free ends 23 and 26 of the anchor are pressed into the soil to firmly secure the anchor 10 in the ground. A guy wire (not shown) or other device can be attached to the top end of the rod 8 to firmly secure a post or other article in position.

What I claim is:

1. An anchor device comprising sleeve means for hammering into the ground; blade means releasably mounted in the bottom end of said sleeve means for facilitating entry of the device into the ground; rod means for insertion into and removal from said sleeve means; elongated plate means, including a center portion extending across and pivotally mounted on said rod means, an upper, resilient leg extending outwardly and upwardly from said center portion on one side of said rod means; and a lower resilient leg extending outwardly and downwardly from the center portion on the other side of said rod means; anchor means pivotally mounted on said rod means for rotation around a horizontal axis, said anchor means being slidable in said sleeve means with said rod means; and spring means on said rod means biasing said anchor means outwardly against said sleeve means when the rod means and anchor means are inserted therein, whereby, when the sleeve means carrying the remainder of the device is hammered into the ground and then extracted while the rod means is held down against the blade means, the spring means biases the anchor means into a ground engaging position.

2. A device according to claim 1, wherein said lower leg of said anchor means extends outwardly and downwardly, and then inwardly toward said rod means.

3. A device according to claim 2, wherein said lower leg includes slot means extending upwardly from the bottom free edge thereof for receiving said rod means, whereby said lower leg overlaps the rod means when the anchor means is in said sleeve means.

4. A device according to claim 1, wherein said spring means is a generally inverted L-shaped leaf spring including a horizontal arm on said rod means and a vertical arm extending downwardly between said rod means and said lower leg of said rod means.

5. A device according to claim 3, wherein said upper leg means includes teeth on the upper free end thereof for digging into the ground.

6. A device according to claim 5, wherein said anchor means includes reinforcing means extending along at least said upper and lower leg means.

7. A device according to claim 6, wherein said reinforcing means includes corrugations extending longitudinally of said anchor means.

* * * * *